US006378503B1

(12) United States Patent
Lambert

(10) Patent No.: US 6,378,503 B1
(45) Date of Patent: Apr. 30, 2002

(54) FUEL INJECTOR

(75) Inventor: Malcolm David Dick Lambert, Bromley (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/616,554

(22) Filed: Jul. 14, 2000

(30) Foreign Application Priority Data

Jul. 14, 1999 (GB) ..... 9916464

(51) Int. Cl.[7] ..... F02M 55/02
(52) U.S. Cl. ..... 123/468; 239/533.12
(58) Field of Search ..... 239/533.12, 533.11, 239/533.2, 533.1, 533.4, 533.5, 533.8, 562, 563, 564; 123/467, 468

(56) References Cited

U.S. PATENT DOCUMENTS 4,168,804 A * 9/1979 Hofmann ..... 239/533.11
4,275,844 A * 6/1981 Grgurich et al. ..... 239/533.3
5,899,389 A * 5/1999 Pataki et al. ..... 239/533.2

* cited by examiner

*Primary Examiner*—Willis R. Wolfe
*Assistant Examiner*—Mahmoud Gimie
(74) *Attorney, Agent, or Firm*—Thomas A. Twomey

(57) ABSTRACT

A fuel injector comprising a nozzle body defining a bore within which an outer valve member is slidable, the outer valve member being engageable with a first seating to control fuel injection from a first outlet opening provided in a nozzle body. The outer valve member is provided with a through bore within which an inner valve member is slidable, the inner valve member being engageable with a second seating to control fuel injection through a second outlet opening provided in the nozzle body. The fuel injector further comprises first and second control chambers for fuel whereby, in use, movement of the inner and outer valve members away from their respective seatings is controlled by controlling fuel pressure within the first and second control chambers so as to permit fuel delivery from a selected outlet opening.

14 Claims, 6 Drawing Sheets

FUEL INJECTOR

TECHNICAL FIELD

This invention relates to a fuel injector for use in supplying fuel under pressure to a combustion space of an internal combustion engine. In particular, the invention relates to a fuel injector in which a characteristic of the fuel injector can be altered, in use.

BACKGROUND OF THE INVENTION

In order to reduce the levels of noise and particulate emissions produced by an engine it is desirable to provide an arrangement whereby the injection characteristics of fuel delivered to the engine can be controlled. For example, it may be desirable to be able to adjust the spray pattern formed by the delivery of fuel by an injector or to adjust the rate of fuel injection. European Patent Application EP 0 713 004 A describes a fuel injector of the type in which the fuel injection characteristic can be varied, in use, by selecting different sets of fuel injector outlet openings provided in the fuel injector nozzle body. By controlling angular motion of a sleeve member, housed within the nozzle body, apertures formed in the sleeve are caused to align with selected ones of the outlet openings. Subsequent inward, axial movement of a valve member within the bore of the nozzle body causes fuel to be ejected from the selected outlet openings. Fuel injectors of this type do, however, have performance limitations.

Additionally, British Patent Application No. 9905231 describes a fuel injector including a nozzle body defining a bore within which an outwardly opening, outer valve member is slideable. Movement of the outer valve member in an outward direction causes fuel to be ejected from an upper group of outlet openings provided in the outer valve member. The outer valve member defines a blind bore within which an inner valve needle is slidable. Inward movement of the inner valve needle causes fuel injection through a lower group of outlet openings provided in the outer valve member. The fuel injection rate is controlled by means of an actuator arrangement which controls the downward force applied to the inner valve member. A fuel injector of this type does, however, suffer from the disadvantages of outwardly opening fuel injectors. For example, a poor spray characteristic is obtained as the outlet openings become exposed and, in addition, fuel leakage can occur from the outlet openings during undesirable stages of the fuel injection cycle.

SUMMARY OF THE INVENTION

It is an object of the present invention to provide an alternative fuel injector which enables the fuel injection characteristics to be varied, in use. It is a further object of the invention to provide a fuel injector which alleviates at least some of the disadvantages of fuel injectors of the outwardly opening type.

According to the present invention, there is provided a fuel injector comprising a nozzle body defining a bore within which an outer valve member is slidable, the outer valve member being engageable with a first seating to control fuel injection from a first outlet opening provided in a nozzle body, the outer valve member being provided with a through bore within which an inner valve member is slidable, the inner valve member being engageable with a second seating to control fuel injection through a second outlet opening provided in the nozzle body, the fuel injector further comprising first and second control chambers for fuel, whereby, in use, movement of the inner and outer valve members away from their respective seatings is controlled by controlling fuel pressure within the first and second control chambers so as to permit fuel delivery from a selected outlet opening.

The second seating may be defined by, or associated with, the outer valve member.

In a first fuel injecting position, the inner valve member only may be lifted away from the second seating and the outer valve member remains seated so that fuel injection occurs only through the second outlet opening. In a second fuel injecting position the outer valve member only may be lifted away from the first seating, a force due to movement of the outer valve member being transmitted to the inner valve member such that the inner valve member remains seated. Preferably, in the second fuel injecting position, fuel delivery through the second outlet opening is prevented. By providing first and second outlet openings of, for example, different size and shape, the fuel injection characteristics can therefore be varied by ejecting fuel from a selected outlet opening.

As inward movement of the outer valve member or the inner valve member away from their respective seatings permits fuel delivery through a selected outlet opening, the spray characteristic of fuel injected into the engine is improved. Furthermore, leakage from the outlet openings during undesirable stages of the fuel injection cycle is substantially avoided.

Conveniently, the outer valve member may include first and second valve parts, the first valve part being engageable with the first seating to control fuel flow through the first outlet opening and the second valve part being engageable with an additional seating. The first and second valve parts may together define a chamber for housing a sealing member and means may be provided for continuously biasing the sealing member against a sealing seating. The provision of the sealing member prevents any fuel leakage through the second outlet opening when the outer valve member is lifted away from the first seating and fuel delivery occurs through the first outlet opening.

In addition, the provision of the sealing member serves to prevent any fuel leakage through the first outlet opening when the inner valve member is lifted away from its seating and fuel delivery occurs through the second outlet opening.

The first and second valve parts of the outer valve member may be integrally formed to form a unitary body or may be separate parts which are connected together.

The first control chamber may be defined within the bore in the nozzle body, fuel pressure within the first control chamber serving to bias the outer valve member against the first seating. The outer valve member may include one or more thrust surfaces such that, in use, fuel pressure acting on the or each outer valve member thrust surface serves to urge the outer valve member inwardly against the action of fuel pressure within the first control chamber.

Fuel pressure within the second control chamber may serve to bias the inner valve member against the second seating. The inner valve member may include one or more thrust surfaces such that, in use, fuel pressure acting on the or each inner valve member thrust surface serves to urge the inner valve member inwardly against the action of fuel pressure within the second control chamber.

The fuel injector may include a piston member, a surface of which is exposed to fuel pressure within the second control chamber, in use, the piston member being arranged to transmit a force due to fuel pressure within the second control chamber to the inner valve member. Preferably, the effective diameter of the surface of the piston member exposed to fuel pressure within the second control chamber is greater than the diameter of the inner valve member.

The fuel injector may further comprise a first control valve arrangement for controlling fuel pressure within the first control chamber and a second control valve arrangement for controlling fuel pressure. within the second control chamber. Alternatively, the fuel injector may comprise a common control valve arrangement arranged to control fuel pressures within both the first and second control chamber.

The first and second outlet openings may be of different form to permit different fuel injection spray characteristics from the first and second outlet openings. For example, the first and second outlet openings may have a different size or each may be shaped to eject fuel with a different fuel spray angle.

The fuel injector may include a single first outlet opening or a group of first outlet openings from which fuel is injected into the engine at the first fuel injecting position. The fuel injector may include a single second outlet opening or a group of second outlet openings from which fuel is injected into the engine at the second fuel injecting position.

BRIEF DESCRIPTION OF THE DRAWINGS

The invention will now be described, by way of example only, with reference to the following drawings, in which.

DESCRIPTION OF THE PREFERRED EMBODIMENT

Figure 1:
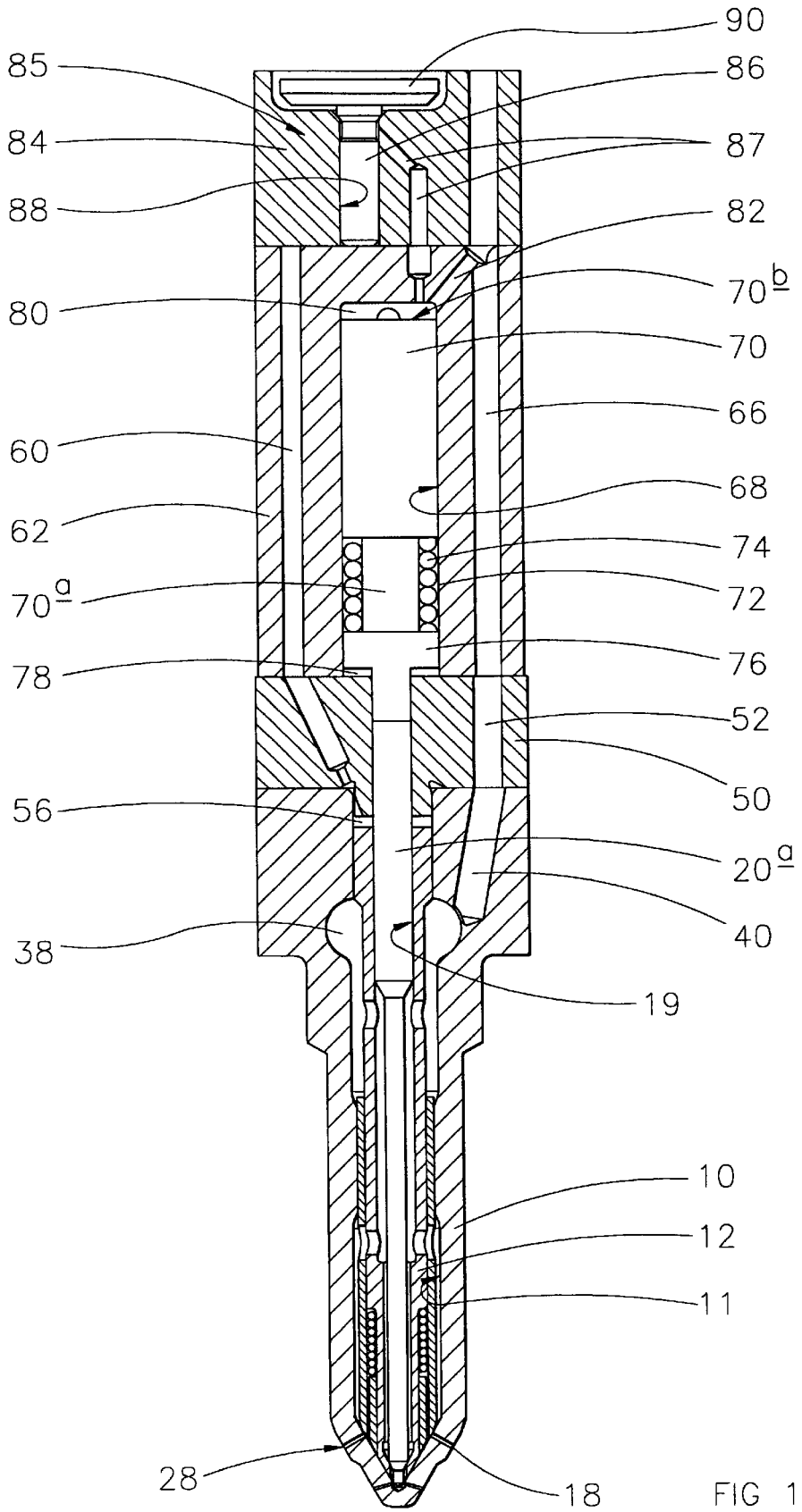
FIG. 1 is an embodiment of a fuel injector in accordance with the present invention.
Figure 2:
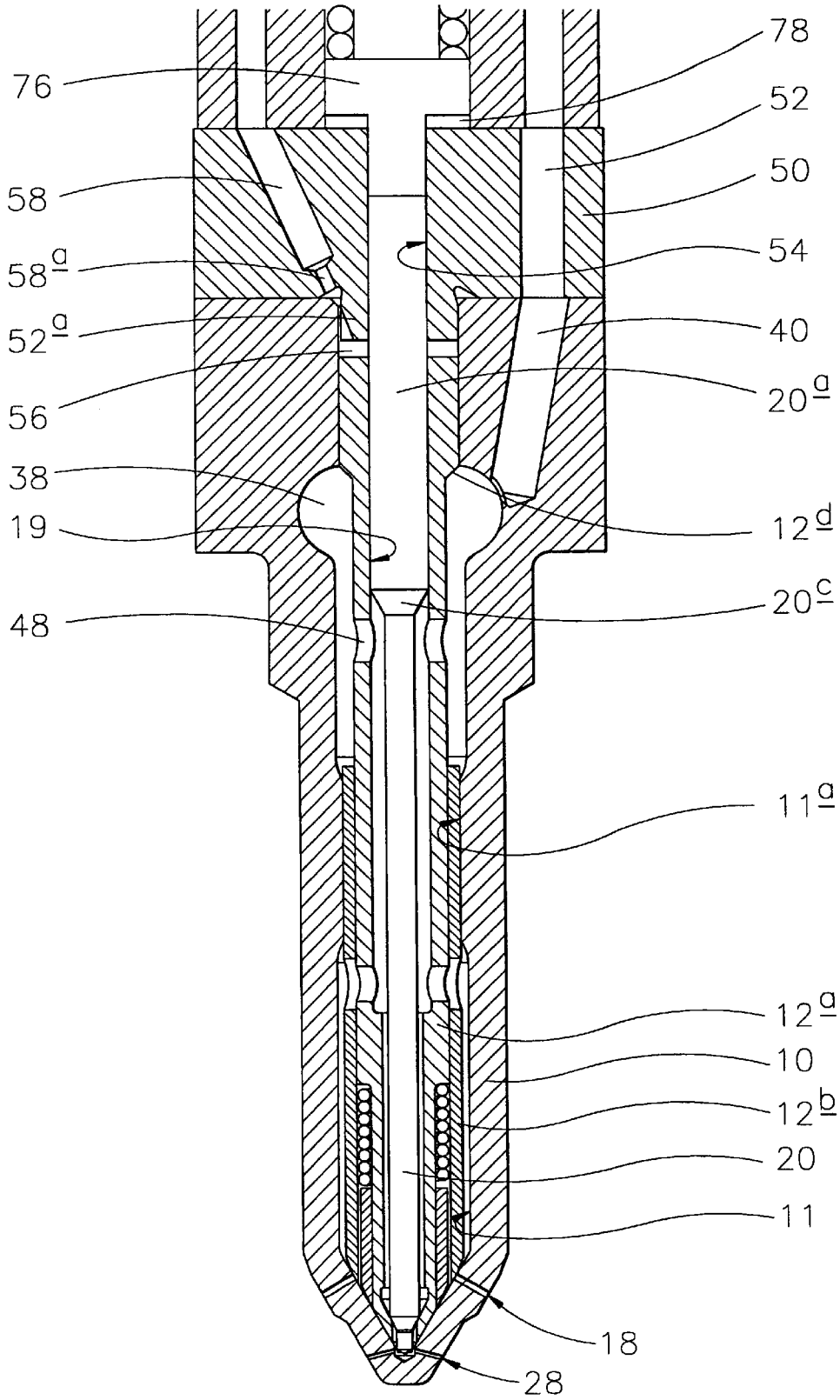
FIGS. 2 and 3 show enlarged views of a part of the fuel injector shown in FIG. 1.
Figure 3:
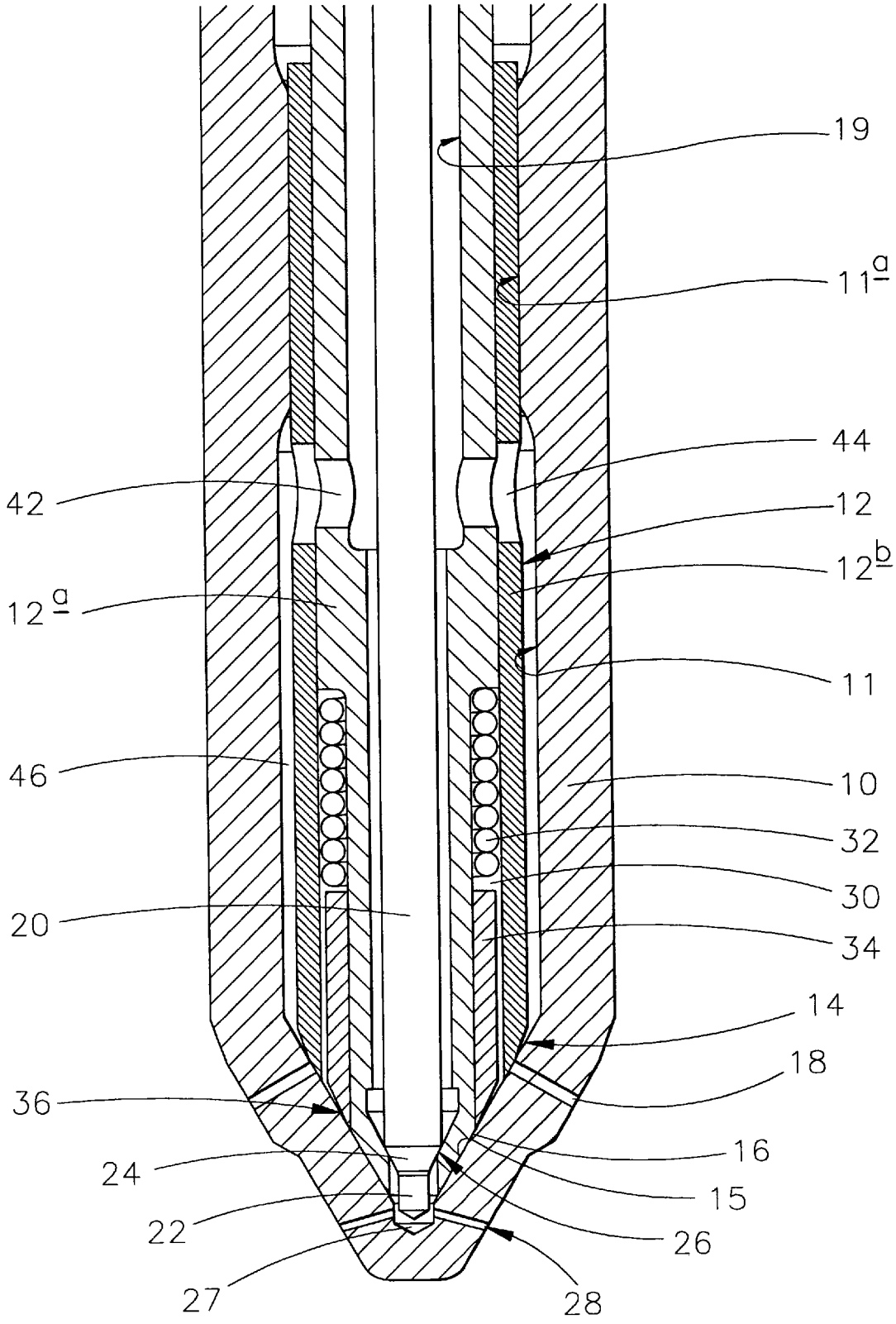

Referring to FIGS. 1, 2 and 3, the fuel injector includes a nozzle body 10 provided with a blind bore 11 within which an outer valve member, referred to generally as 12, is slidable. The outer valve member 12 comprises an inner valve portion 12*a* and an outer valve portion 12*b*, the outer valve portion 12*b* and the inner valve portion 12*a* being connected such that they slide together within the bore 11. The bore 11 has a region of reduced diameter 11*a*, having substantially the same diameter of the adjacent part of the outer valve portion 12*b*, which serves to guide sliding movement of the outer valve member 12 within the bore 11. The end of the outer valve portion 12*b* at the blind end of the bore 11 is of substantially frusto-conical form and is engageable with a first, frusto-conical seating 14 defined by the bore 11. The end of the inner valve portion 12*a* at the blind end of the bore 11 is also of frusto-conical form and defines, with the blind end of the bore 11, a clearance 16, the inner valve portion 12*a* being engageable with a further seating 15 defined by the bore 11. In use, inward movement of the outer valve member 12 moves the outer valve portion 12*b* away from the first seating 14 to control fuel flow through a first set of outlet openings 18 provided in the nozzle body 10.

The inner valve portion 12*a* of the outer valve member 12 is provided with a through bore 19 within which an inner valve needle 20 is slidable. The inner valve needle 20 includes a tip portion 22 which extends through an open end of the through bore 19 into a sac region 27 at the blind end of the bore 11, the tip portion 22 being spaced from the main body of the inner valve needle 20 by an intermediate section 24 of frusto-conical form which engages a third seating 26 defined by the through bore 19. At the end of the inner valve needle 20 remote from the tip portion 22 the inner valve needle 20 has a region 20*a* of enlarged diameter, having substantially the same diameter as the adjacent part of the bore 19, which serves to guide sliding movement of the inner valve needle 20 within the bore 19. The inner valve needle 20 also includes a thrust surface 20*c* such that, in use, fuel pressure within the through bore 19 acts on the thrust surface to urge the inner valve needle 20 away from its seating 26. Movement of the intermediate section 24 of the inner valve needle 20 away from the seating 26 permits fuel flow through a second set of outlet openings 28 provided in the nozzle body 10.

The inner valve portion 12*a* is also shaped to define, with an inner surface of the outer valve portion 12*b*, a chamber 30 which houses, at the end of the chamber 30 remote from the blind end of the bore 11, a compression spring 32. The spring 32 serves to bias a sealing member 34, also housed within the chamber 30, against a sealing seating 36 defined by the bore 11.

At the end of the nozzle body 10 remote from the outlet openings 18,28, the nozzle body 10 is provided with an annular chamber 38 which communicates with a supply passage 40 for fuel, provided by a drilling formed in the nozzle body 10, the annular chamber 38 also communicating with the bore 11. The supply passage 40 communicates with a source of fuel at high pressure (not shown), for example a common rail of a common rail fuel system, the common rail being arranged to be charged to a suitably high pressure by an appropriate high pressure fuel pump, such that high pressure fuel can be introduced into the annular chamber 38.

The inner and outer valve portions 12*a*, 12*b* are provided with openings 42,44 respectively which communicate with a delivery chamber 46 for fuel defined by the bore 11 and the outer surface of the outer valve portion 12*b*. In addition, the inner valve portion 12*a* is provided with a second opening 48 which communicates with the part of the bore 11 communicating directly with the annular chamber 38. Thus, fuel supplied to the annular chamber 38 by means of supply passage 40 is able to flow through the second opening 48 provided in the inner valve portion 12*a* into the through bore 19 and through the openings 42,44 into the delivery chamber 46. The inner valve portion 12*b* of the outer valve member 12 is provided with a thrust surface 12*d*, fuel pressure within the annular chamber 38 acting on the thrust surface 12*d* to urge the inner valve portion 12*a* away from its seating 15.

The end of the nozzle body 10 remote from the outlet openings 18,28 abuts a distance piece 50 provided with a drilling defining a first flow passage 52 which communicates with the supply passage 40. The distance piece 50 is also provided with a through bore 54 which extends coaxially with the through bore 19 provided in the inner valve portion 12*a*, the enlarged region 20*a* of the inner valve needle 20 extending part of the way into the bore 54. The distance piece 50 includes a projecting part 52*a* which extends into the bore 11, the projecting part 52*a* defining, with an upper end face of the inner valve portion 12*a*, a first control chamber 56 for fuel. Fuel is able to flow into the control chamber 56 by leakage between the distance piece 50 and the nozzle body 10. Alternatively, flats, slots or grooves (not shown) may be provided in the nozzle body or the inner valve portion 12*a* to permit fuel flow into the first control chamber 56. Fuel pressure within the control chamber 56 serves to bias the inner valve portion 12*a* in a downward direction, therefore serving to bias the outer value portion 12*b* and the inner valve portion 12*a* against their respective seatings 14,15 against the force applied to the thrust surface 20*c* and the thrust surface 12*d*. A second flow passage 58 is also provided in the distance piece 50, the second flow passage 58 communicating with a supply passage 60 defined in an upper housing part 62 of the fuel injector. The supply passage 60 communicates with a low pressure fuel reservoir (not shown) by means of a control valve arrangement (not shown). Opening and closing the control valve arrangement therefore controls fuel pressure within the first control chamber 56. Additionally, the second flow passage 58 is provided with a flow restrictor 58*a* which serves to limit the rate of fuel flow to low pressure from the control chamber 56.

The housing part 62 is also provided with a further drilling which defines a flow passage 66 for fuel, the flow passage 66 communicating with the passage 52 in the distance piece 50, which in turn communicates with supply passage 40 in the nozzle body 10, to permit high pressure fuel to flow into the annular chamber 38 and, thus, into the downstream parts of the fuel injector. The housing part 62 is also provided with a blind bore 68 within which a piston member 70 is slidable. The piston member includes a projection 70*a* of reduced diameter which defines, with the bore 68, a spring chamber 72. The spring chamber 72 houses a compression spring 74 which abuts one surface of a T-shaped abutment member 76, the opposed surface of the abutment member 76 abutting the upper end face of the enlarged region 20*a* of the inner valve needle 20. Thus, movement of the piston member 70 in a downwards direction is transmitted, via the abutment member 76, to the inner valve needle 20.

An upper end face 70*b* of the piston 70 and the blind end of the bore 68 together define a second control chamber 80 for fuel which communicates, via a restricted passage 82, with the supply passage 66 so that high pressure fuel is able to flow into the control chamber 80. Fuel pressure within the control chamber serves to bias the piston 70 in a downwards direction against the force applied to the thrust surfaces 20*c*,12*d* due to fuel pressure within the through bore 19 and the annular chamber 38 respectively. Fuel pressure within the second control chamber 80 is controlled by means of a second control valve arrangement, referred to generally as 85, provided in a second housing part 84 which abuts the housing part 62. The control valve arrangement includes a control valve member 86 which is slidable within a bore 88 defined in the housing part 84 under the control of an actuator arrangement which includes an armature plate 90 (as shown in FIG. 1). Alternatively, the actuator arrangement may be, for example, a piezoelectric actuator arrangement.

The control valve member 86 is engageable with a seating defined by the bore 88 to control fuel flow to a low pressure fuel reservoir (not shown). Fuel is able to flow from the control chamber 80 past the seating of the control member 86 via drillings 87 formed in the housing part 84.

When the control valve member 86 is seated against the seating, high pressure fuel within the control chamber 80 is unable to flow to the low pressure fuel reservoir. When the control valve member 86 is moved away from its seating the control valve arrangement is open to permit high pressure fuel within the second control chamber 80 to flow to the low pressure fuel reservoir, thereby reducing fuel pressure within the control chamber 80.

The relative surface areas of the end face 70*b* of the piston 70 and the thrust surface 20*c* of the inner valve needle 20 are arranged such that, when the control valve arrangement 85 is closed, high pressure fuel within the second control chamber 80 serves to bias the piston member 70, the abutment member 76 and the inner valve needle 20 in a downwards direction against the force applied to the thrust surface 20*c* by fuel pressure within the bore 19. When the control valve arrangement 85 is opened, the force applied to the thrust surfaces 20*c* of the inner valve needle 20 due to fuel pressure within the bore 19 is sufficient to overcome the force applied to the end face 70*b* of the piston and the inner valve needle 20 is lifted away from its seating 26, as will be described in further detail hereinafter.

It will be appreciated that the control valve arrangement for controlling fuel pressure within the first control chamber 56 may, but need not, be of a similar type to the control valve arrangement 85 for controlling fuel pressure within the second control chamber 80. Alternatively, fuel pressure within the first and second control chambers may be controlled by means of a common control valve arrangement.

The operation of the fuel injector, during various stages of the fuel injection cycle, will now be described. In use, with high pressure fuel supplied to supply passages 66,40 such that fuel flows into the annular chamber 38, the bore 19 and the delivery chamber 46, with the control valve arrangement associated with the first control chamber 56 closed and with the control valve arrangement 85 closed, high pressure fuel within the second control chamber 80 serves to bias the piston member 70, the abutment member 76 and the inner valve needle 20 in a downwards direction against the force applied to the thrust surface 20*c* by fuel in the bore 19. Thus, the frusto conical section 24 of the inner valve needle 20 remains seated against the seating 26. During this stage of operation, fuel flowing into the annular chamber 38 and into the through bore 19 through the opening 48 is unable to flow past the seating 26 into the sac region 27 and fuel injection through the second set of outlet openings 28 does not take place. In addition, the surface area of the end face of the inner valve needle 20 exposed to fuel pressure within the control chamber 56 is greater than the effective surface area of the thrust surface 12*d* such that fuel pressure within the control chamber 56 biases the outer valve portion 12*b* in a downwards direction against its seating 14. Fuel within the bore 19 flowing through the openings 42,44 into the delivery chamber 46 is unable to flow past the seating 14 and fuel injection through the first set of outlet openings 18 does not therefore take place. FIGS. 1 to 3 show the fuel injector during this stage of operation.

Figure 4:
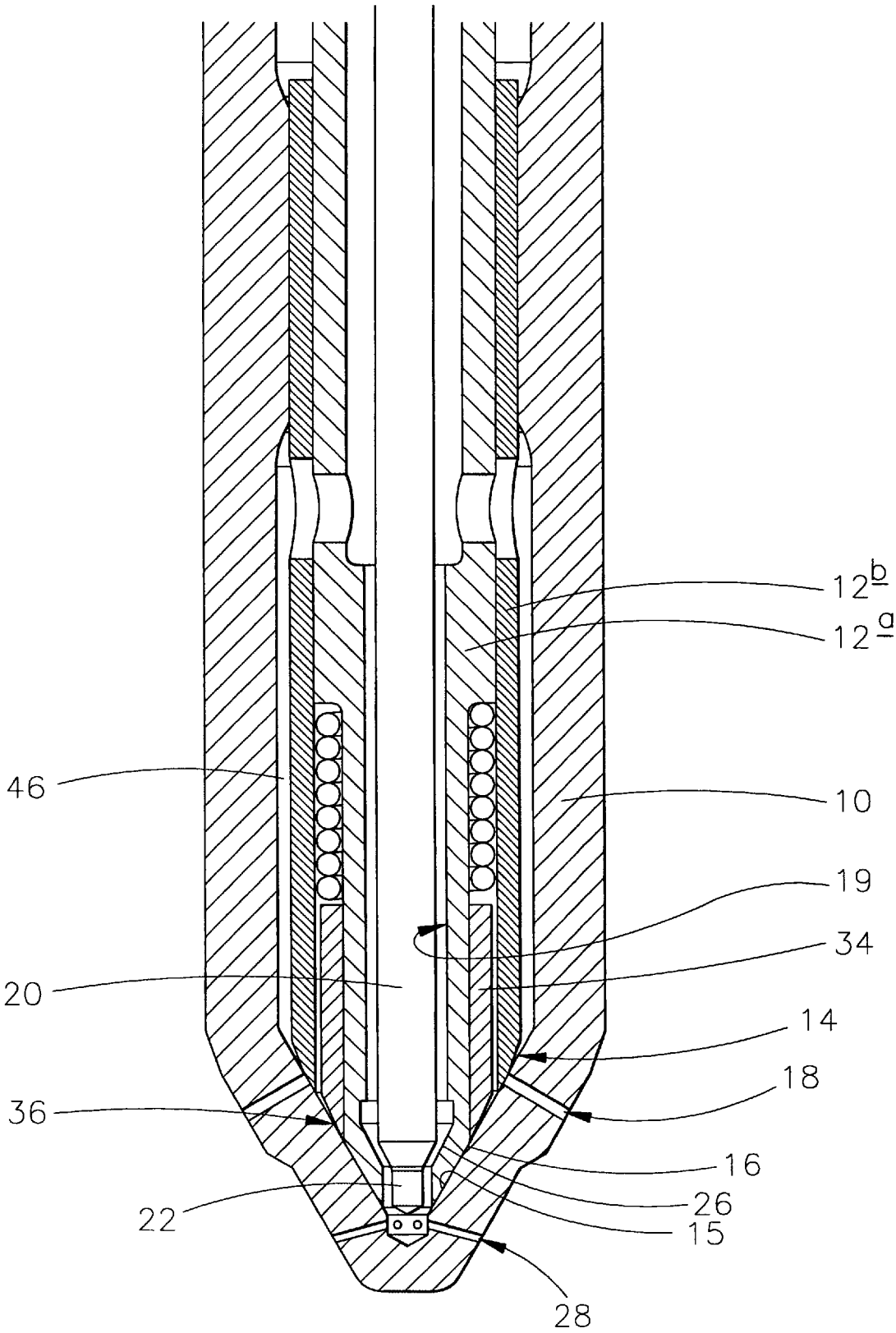
FIG. 4 is an enlarged view of the fuel injector shown in FIGS. 1–3 in a fuel injecting position in which fuel injection occurs from a first set of outlet openings.

Referring to FIG. 4, when fuel injection is to be commenced through the second set of outlet openings 28, the control valve arrangement controlling fuel pressure within the first control chamber 56 is maintained in its closed position to maintain a high fuel pressure within the first control chamber 56. High fuel pressure within the control chamber 56 serves to maintain the outer valve portion 12*b* against its seating 14 against the action of the force applied to the thrust surfaces 12*d* due to fuel pressure within the annular chamber 38. In addition, the control valve member 86 of the control valve arrangement 85 is opened so that fuel within the second control chamber 80 is able to flow, via the drillings 87, past the seating of the control valve member 86 to the low pressure reservoir. As fuel is able to escape from the second control chamber 80, and the rate at which fuel is able to flow to the second control chamber is limited by the passage 82, fuel pressure within the second control chamber 80 is reduced and a point will be reached beyond which the abutment member 76 and the inner valve needle 20 move in an upwards direction. Thus, as shown in FIG. 4, the inner valve needle 20 is lifted away from the seating 26 and fuel within the through bore 19 is able to flow past the seating 26 into the sac region 27 and out through the second set of outlet openings 28.

During this stage of operation, fuel is unable to flow from the delivery chamber 46 through the first set of outlet openings 18 as the outer valve portion 12*b* of the outer valve member 12 remains seated against the seating 14 and the sealing member 34, which is seated against the sealing seating 36, prevents any fuel in the sac region 27 leaking through the clearance 16, past the sealing seating 36 and flowing through the first set of outlet openings 18. In these circumstances, it will therefore be appreciated that fuel injection only takes place through the second set of outlet openings.

From the position shown in FIG. 4, if it is desired to cease fuel injection, the control valve arrangement 85 is closed. Thus, high pressure fuel flowing into the second control chamber 80 is unable to flow past the seating of the control valve member 86 to the low pressure fuel reservoir. The fuel pressure within the second control chamber 80 increases and overcomes the force applied to the thrust surface 20*c* due to fuel pressure within the bore 19. Thus, the inner valve needle 20 is returned against its seating 26. Fuel within the bore 19 is no longer able to flow past the seating 26 into the sac region 27 and out through the second set of outlet openings 28 and fuel injection ceases.

Alternatively, from the position shown in FIG. 3, in order to inject fuel from the first set of outlet openings 18, the control valve arrangement for the first control chamber 56 and the control valve arrangement 85 are opened. Fuel is therefore able to flow from the first control chamber 56 to low pressure, thereby reducing fuel pressure within the control chamber 56. As the control valve arrangement 85 is also open at this time fuel within the second control chamber 80 is also able to flow to low pressure and fuel pressure within the second control chamber 80 is also relatively low.

As the fuel pressure within the first control chamber 56 is reduced, the force applied to the thrust surface 12*d* by fuel pressure within the annular chamber 38 is sufficient to overcome fuel pressure within the first control chamber 56 and the outer valve member 12 moves in an upwards direction, moving the outer valve portion 12*b* and the inner valve portion 12*a* away from the seating 14. Movement of the outer valve member 12 in an upwards direction is transmitted to the inner valve needle 20 due to the engagement between the seating 26 and the intermediate section 24 of the inner valve needle and due to upward movement of the inner valve needle 20 due to the force applied to the thrust surface 20*c* against the action of the reduced fuel pressure within the control chamber 80.

Figure 5:
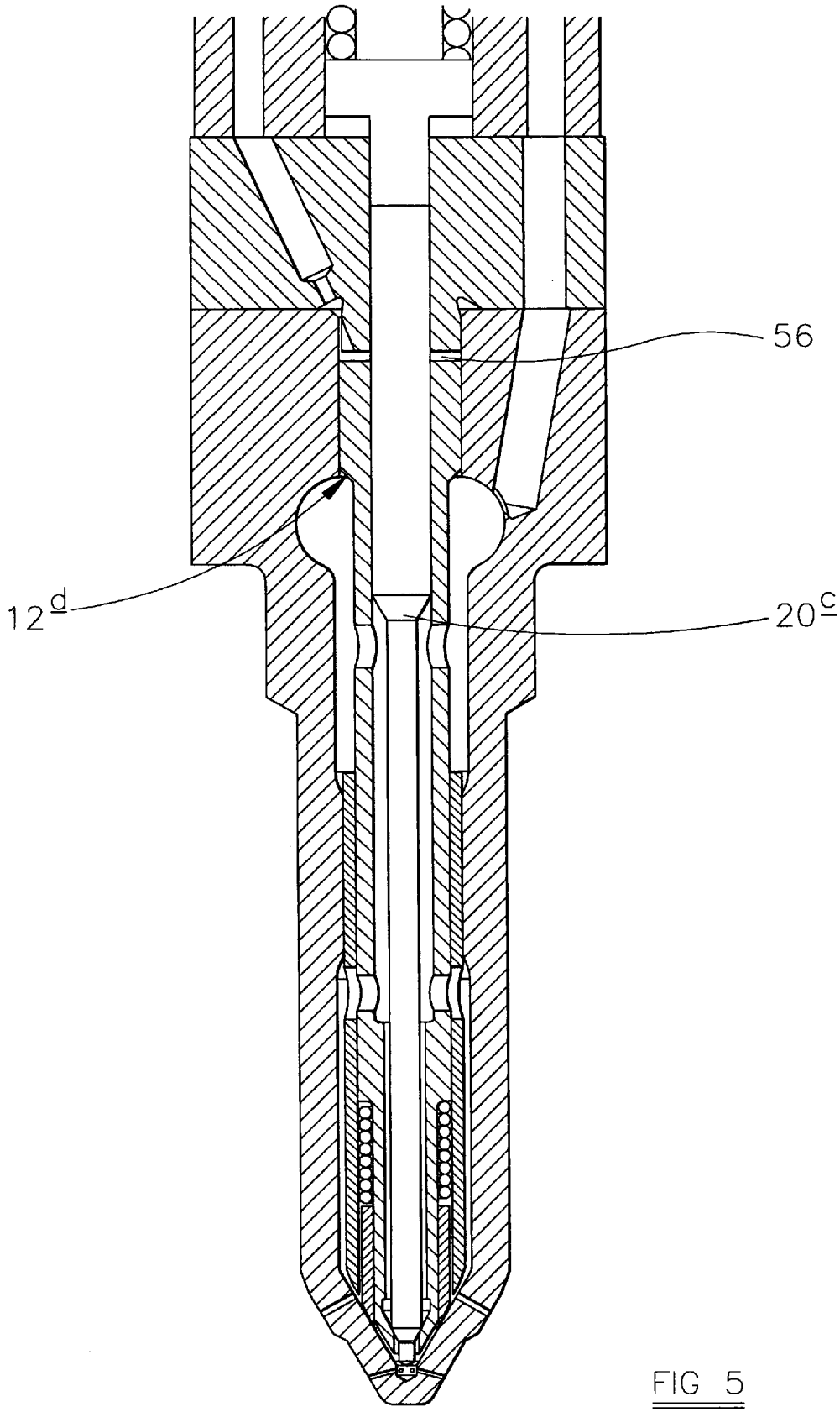
FIGS. 5 and 6 are enlarged views of the fuel injector shown in FIGS. 1–3 in a fuel injecting position in which fuel injection occurs from a second set of outlet openings.
Figure 6:
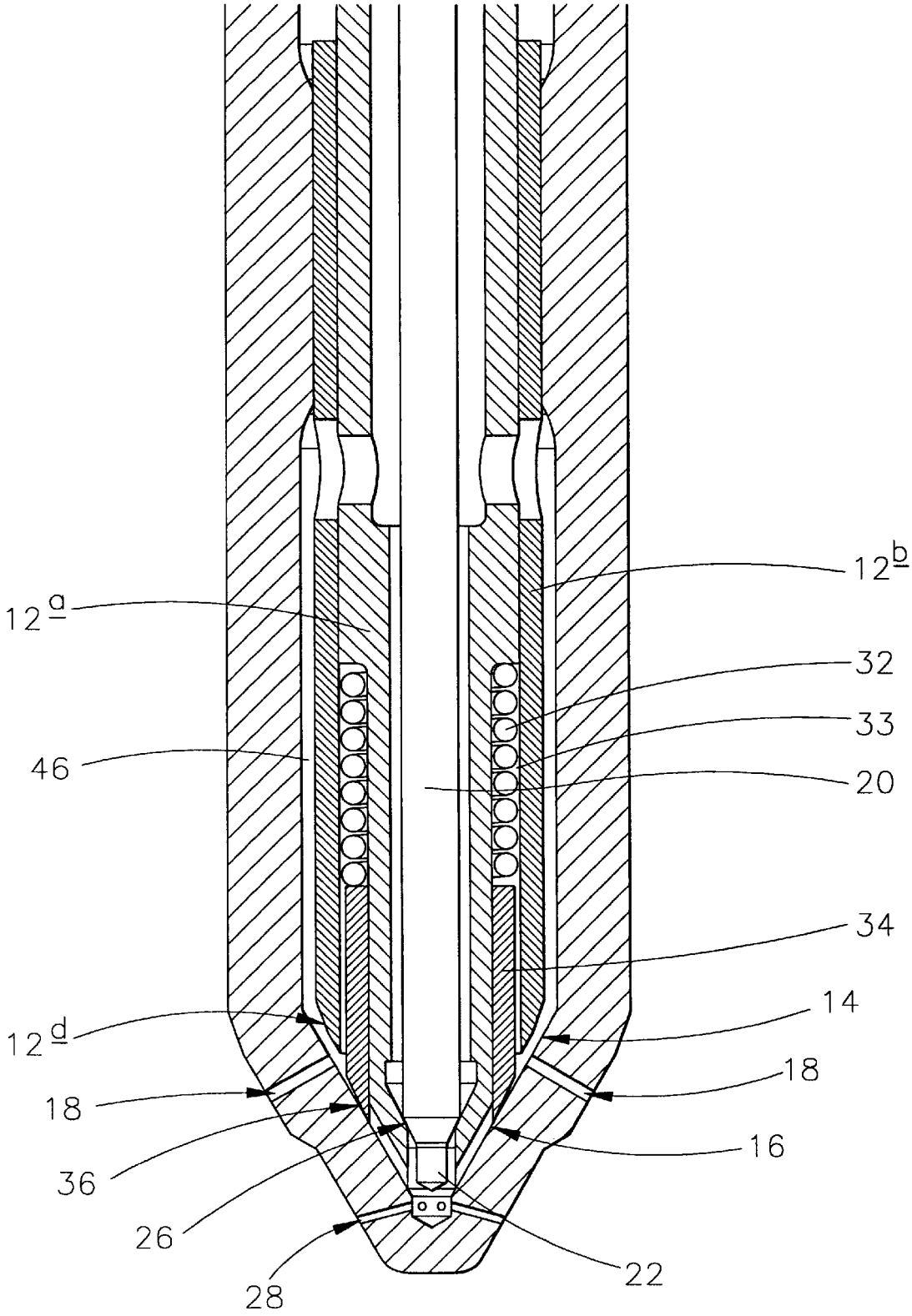

Thus, as shown in FIGS. 5 and 6, during this stage of operation fuel within the bore 19 is unable to flow past the seating 26 into the sac region 27 and out through the second set of outlet openings 28 but fuel within the delivery chamber 46 is able to flow past the seating 14 and out through the first set of outlet openings 18. Fuel injection therefore only takes place through the first set of outlet openings 18. As the compression spring 32 maintains the sealing member 34 against the sealing seating 36, fuel within the delivery chamber 46 flowing past the seating 14 is unable to flow into the sac region 27 and out through the second set of outlet openings 28. In addition, leakage of fuel from the spring chamber 34 through the narrow clearance defined between the sealing member 34 and the inner valve portion 12*a* is restricted due to fuel pressure within the delivery chamber 46 and between the sealing member 34 and the outer valve portion 12*b*. Fuel leakage from the second set of outlet openings 28 is therefore substantially avoided.

During this stage of operation, by only opening the control valve arrangement associated with the first control chamber 56, with the control valve arrangement 85 remaining closed, the force applied to the thrust surface 12*d* by fuel pressure within the annular chamber 38 is not sufficient to lift the inner valve portion 12*a* and the outer valve portion 12*b* in an upwards direction away from their respective seatings. Only when the control valve arrangement 85 is opened and fuel pressure within the second control chamber 80 is reduced will the inner valve portion 12*a* and the outer valve portion 12*b* both lift away from their respective seatings, aided by the upwards force applied to the thrust surface 20*c* of the valve needle 20 by fuel pressure within the bore 19.

From the position shown in FIGS. 5 and 6, in order to cease fuel injection the control valve arrangement 85 associated with the second control chamber 80 and the control valve arrangement associated with the first control chamber 56 are both closed to re-establish high fuel pressure within both the second and first control chambers 80,56 respectively. Thus, the inner valve needle 20 and the outer valve portion 12*b* of the outer valve member 12 are biased in a downwards direction against their respective seatings 26 and 14. Fuel in the delivery chamber 46 is therefore unable to flow past the seating 14 out through the first set of outlet openings 18 and fuel in the bore 19 is unable to flow past the seating 26 into the sac region 27 and out through the second group of outlet openings 28. Fuel injection therefore ceases.

In an alternative embodiment of the invention, instead of the openings 42,44 and 48 provided in the inner and outer valve portions 12*a*,12*b*, slots, flats, grooves or flutes may be provided to permit fuel flow between the bore 19 and the delivery chamber 46 and between the bore 19 and the bore 11. In addition, rather than supplying fuel under pressure to the first control chamber 56 from the common rail system supplying the fuel under pressure to the annular chamber 38 in the nozzle body 10, an additional rail system may be provided. In a further alternative embodiment, sliding movement of the inner valve needle 20 may be guided by the bore 54 in the distance piece 50 in addition to, or in place of, the bore 19 adjacent the enlarged end region 20*a* of the inner valve needle 20.

The number of outlet openings in the first set 18 may be different from the number of outlet openings in the second set 28. In addition, it will be appreciated that fewer or more outlet openings than those illustrated may be provided. The outlet openings may be of different form in each of the two sets to permit the spray pattern of fuel injected into the engine to be varied, in use, by selecting different ones of the first and second outlet openings 18,28.

What is claimed is:

1. A fuel injector comprising a nozzle body defining a bore within which an outer valve member is slidable, the outer valve member being engageable with a first seating to control fuel injection from a first outlet opening provided in the nozzle body, the outer valve member being provided with a through bore within which an inner valve member is slidable, the inner valve member being engageable with a second seating to control fuel injection through a second outlet opening provided in the nozzle body, the fuel injector further comprising first and second control chambers for fuel, whereby, in use, movement of the inner valve member away from its seating is independently controlled by controlling the pressure in the second control chamber and movement of the outer valve member is independently controlled by controlling the pressure in the first control chamber so as to permit fuel delivery from a selected outlet opening.

2. The fuel injector as claimed in claim 1, wherein the second seating is defined by the outer valve member.

3. The fuel injector as claimed in claim 1, the inner valve member and the outer valve member being arranged to have a first fuel injecting position in which the inner valve member is lifted away from the second seating whilst the outer valve member remains seated so that fuel injection occurs only through the second outlet opening.

4. The fuel injector as claimed in claim 3, the outer valve member and the inner valve needle being arranged to have a second fuel injecting position in which the outer valve member is lifted away from the first seating to permit fuel injection through the first outlet opening, a force due to movement of the outer valve member being transmitted to the inner valve member to move the inner valve member with the outer valve member such that the inner valve member remains seated against the second seating.

5. The fuel injector as claimed in claim 4, comprising a sac region into which fuel flows, in use, when the inner and outer valve members adopt their second fuel injecting position.

6. The fuel injector as claimed in claim 1, wherein the outer valve member is provided with an opening to permit fuel to flow into the through bore, in use.

7. The fuel injector as claimed in claim 1, wherein the outer valve member includes first and second valve parts, the first valve part being engageable with the first seating to control fuel flow through the first outlet opening.

8. The fuel injector as claimed in claim 7, wherein the first and second valve parts of the outer valve member are integrally formed.

9. The fuel injector as claimed in claim 7, wherein the first and second valve parts together define a chamber for housing a sealing member.

10. The fuel injector as claimed in claim 9, further comprising a biasing arrangement for biasing the sealing member against a sealing seating.

11. The fuel injector as claimed in claim 1, wherein the first control chamber is defined within the bore provided in the nozzle body, fuel pressure within the first control chamber serving to urge the outer valve member against the first seating.

12. The fuel injector as claimed in claim 1, comprising a piston member, a surface of which is exposed to fuel pressure within the second control chamber, the piston member being arranged to transmit a force due to fuel pressure within the second control chamber to the inner valve member.

13. The fuel injector as claimed in claim 1, comprising a first control valve arrangement for controlling fuel pressure within the first control chamber and a second control valve arrangement for controlling fuel pressure within the second control chamber.

14. The fuel injector as claimed in claim 1, comprising a common control valve arrangement arranged to control fuel pressure within both the first and second control chambers.

* * * * *